US005647250A

United States Patent [19]

Holmer

[11] Patent Number: 5,647,250

[45] Date of Patent: Jul. 15, 1997

[54] TOOL GUIDE FOR SKI EDGE TUNING

[76] Inventor: Scott R. Holmer, 255 SW. Century Dr., Bend, Oreg. 97702

[21] Appl. No.: 540,820

[22] Filed: Oct. 10, 1995

[51] Int. Cl.[6] ..... B23D 64/02; A63C 11/06

[52] U.S. Cl. ..... 76/83; 451/349

[58] Field of Search ..... 76/82, 83, 82.2, 76/82.1; D8/91; 451/314, 349

[56] References Cited

U.S. PATENT DOCUMENTS

| | | | |
|---|---|---|---|
| D. 327,401 | 6/1992 | Howden | D8/91 |
| 493,174 | 3/1893 | McClure . | |
| 1,196,399 | 8/1916 | Ryan . | |
| 2,032,640 | 3/1936 | Swetta et al. | 76/83 |
| 4,030,382 | 6/1977 | Nilsson et al. | 76/83 |
| 4,060,013 | 11/1977 | Thompson | 76/83 |
| 4,089,076 | 5/1978 | Sparling | 76/83 X |
| 4,121,484 | 10/1978 | Gorlach et al. | 76/83 |
| 4,280,378 | 7/1981 | Levine | 76/83 |
| 4,442,636 | 4/1984 | Obland | 76/83 X |
| 4,601,220 | 7/1986 | Yurick, Jr. | 76/83 |
| 4,663,993 | 5/1987 | Weninger et al. | 76/83 |
| 4,721,020 | 1/1988 | Stumpf | 76/83 |

FOREIGN PATENT DOCUMENTS

| | | | |
|---|---|---|---|
| 1279764 | 2/1991 | Canada | A63C 11/06 |

*Primary Examiner*—Douglas D. Watts

*Attorney, Agent, or Firm*—Ken J. Pedersen; Barbara S. Pedersen

[57] ABSTRACT

Embodiments of a tool guide are shown and described, each guide being for placement on a ski or other surface having an edge to be sharpened. The guide abuts against and travels along the ski edge that is being beveled by the tool, so that the file contacts the edge at a constant angle along the entire length of the ski, regardless of variations in ski width. The guide has an elevation member which holds one end of the tool at an elevated position, generally in the center region of the ski base, and allows the other end of the tool to rest on the ski edge. The guide includes one or more feet which abut against the side of the ski and a spacing member to connect the elevation member to the feet, so that the elevation member is kept at constant distance from the ski edge as the guide and tool are moved along the length of the ski. Little of the guide, except for the elevation member and the feet contact the ski, resulting in a self-cleaning design.

11 Claims, 5 Drawing Sheets

TOOL GUIDE FOR SKI EDGE TUNING

BACKGROUND OF THE INVENTION

1. Field of the Invention

This invention relates generally to hand-held tool guides for use in tuning of snow ski edges. More specifically, this invention relates to guides that hold a tool at a predetermined angle relative to the base of a ski.

2. Related Art

Skiers and ski technicians sharpen and polish the metal edges of snow skis to optimize the ski's "bite" into the snow and to improve the ski's overall performance. Edge angles and sharpening techniques vary with the ski design, ski event, and personal preference of the skier. In general, the edges are sharpened to an angle ranging between about 83°–90°, with the base edge surface typically being beveled to ½°, 1°, or 2° from the plane of the ski base.

To bevel the base edge of the ski, a file, stone, or other sharpening tool is typically moved along the base of the ski in the direction of the longitudinal axis of the ski. The tool is held at a slight angle relative to the base so that the tool abrasive surface only touches the metal ski edge. Tape is sometimes wrapped around the back end of the tool, so that the tool back end rests on the non-abrasive tape at a slight angle to the ski base. Thus, the taped tool can be moved along the ski base at roughly the desired angle, with the abrasive surface of the tool contacting only the metal edge.

Although this "taped tool" technique is an improvement over simply trying to hold the tool at a constant angle in one's hands, it still makes ski tuning a difficult and imprecise art. The appropriate amount, type, and placement of tape must be learned by trial and error, and the sharpening angle and overall results vary depending on the "give" in the tape and the condition of the tape.

Howden (U.S. Pat. No. 327,401) discloses a set of beveling sleeves for holding a file at a slight angle across a ski. In the Howden design, a first and a second sleeve receive the front and back ends of the file, respectively, and rest on the first side and second side of the ski, respectively. Thus, the Howden device in U.S. Pat. No. 327,401 extends all the way across the width of the ski.

An alternative design by Howden has only one sleeve which travels along the side of the ski opposing the edge that is being beveled. This device follows the contour of the opposing side and therefore changes the angle at which the file contacts the edge as is moves along the length of the ski.

SUMMARY OF THE INVENTION

An object of the present invention is to provide an improved tool guide for use in establishing and maintaining an exact predetermined bevel angle on the entire length of the base edge of a ski. Another object of the invention is to provide a simple and economical tool guide that eliminates the guesswork and imprecision inherent in standard tuning techniques and that can be used with a variety of different tuning tools. Another object of the invention is to allow the tuning system to be self-cleaning and non-damaging to the ski surfaces.

The present invention comprises an elevation strip, a stop means, and a spacing means connecting the elevation strip and the stop means. The elevation strip has a predetermined thickness, and rests on the base of the ski to support the back end of the tuning tool. The stop means abuts against a side of the ski. The spacing means connects the elevation strip and the stop means at a predetermined distance from each other, in effect, placing the elevation strip at a predetermined distance from the ski edge. In use, the front end of the tool rests on the metal ski edge and the back end of the tool rests on the top surface of the elevation strip, thus, placing the tool at a predetermined angle relative to the ski base and the ski edge.

To make the guide sturdy and the tuning procedure precise and reproducible, the guide is preferably designed with enough structure to keep the guide rigid and to contain the tool as it is moved along the ski. This structure preferably includes two sidewalls that act as the spacing means and two depending feet that act as the stop means. The sidewalls are spaced apart, by slightly more than the width of a file or other preferred tuning tool, and extend between the elevation strip and the two feet. The tuning tool rests between the sidewalls and can be moved within the sidewalls across the width of the ski to present fresh abrasive surface to the ski edge.

To make the system self-cleaning, preferably little of the guide touches the ski, except for the elevation strip and the two feet. Gaps preferably exist between the ski base surface and curved sidewalls and also between the ski side surface and the brace member that connects the two feet. Thus, filings may fall away from the tool and the ski edge without gouging the ski surface.

DETAILED DESCRIPTION OF THE PREFERRED EMBODIMENT

Figure 1:
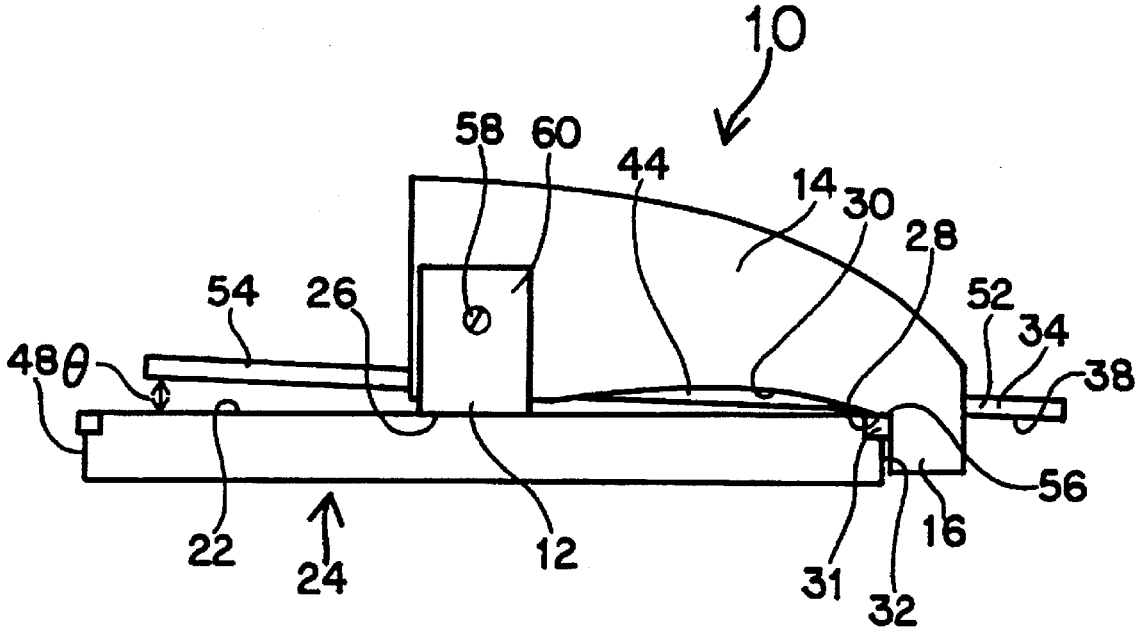
FIG. 1 is a side view of one embodiment of the invented tool guide holding a file and installed on a snow ski, wherein the ski is therefore viewed from its end.
Figure 2:
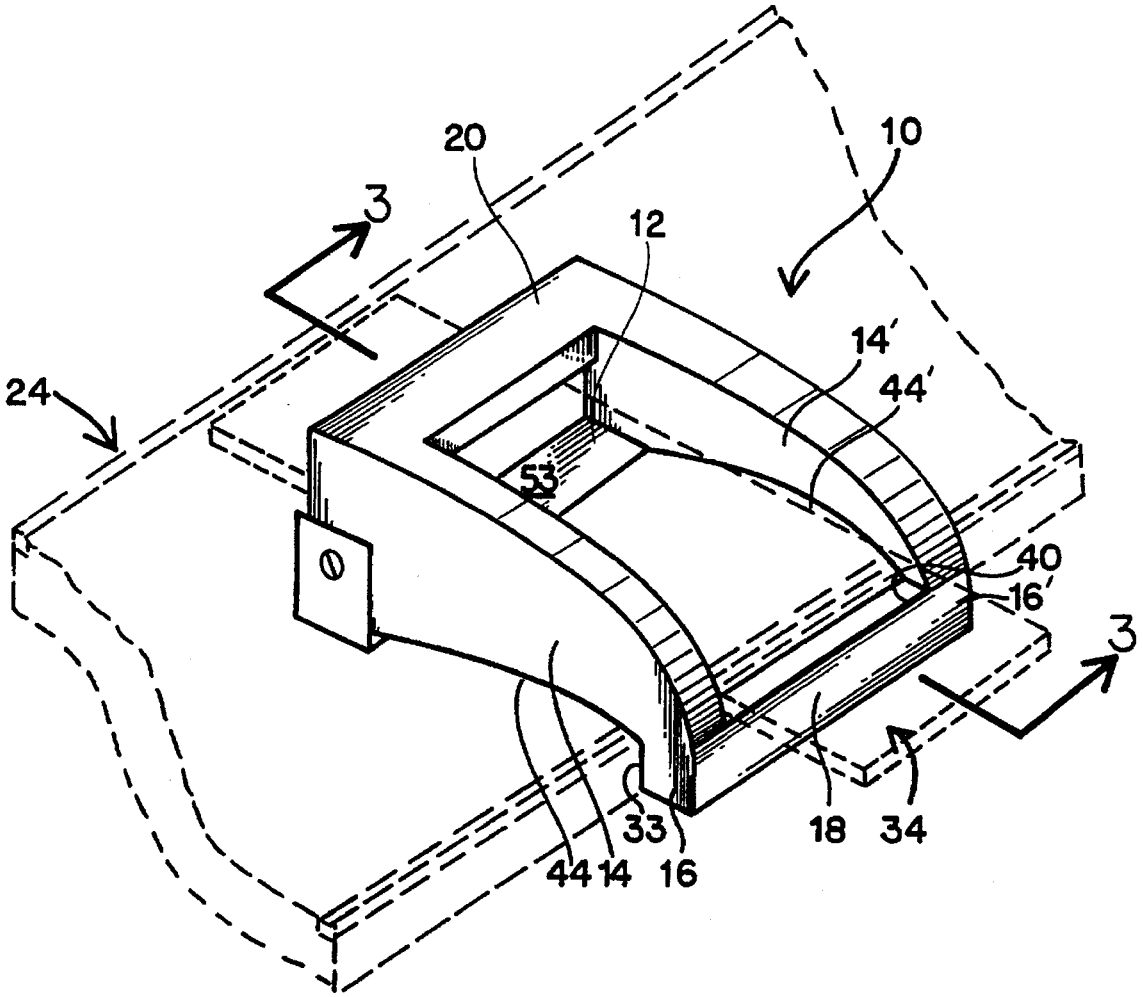
FIG. 2 is a perspective view of the tool guide embodiment of FIG. 1, shown with the file and ski in dashed lines.
Figure 3:
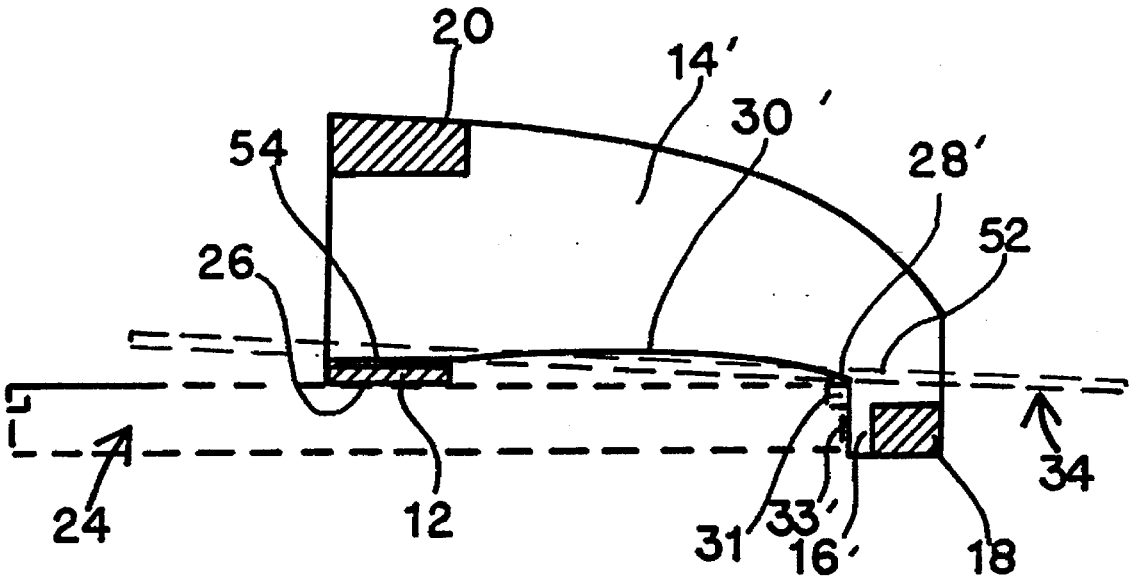
FIG. 3 is side, cross-sectional view of the embodiment of FIG. 1, as viewed along the line 3—3 in FIG. 2.
Figure 4:
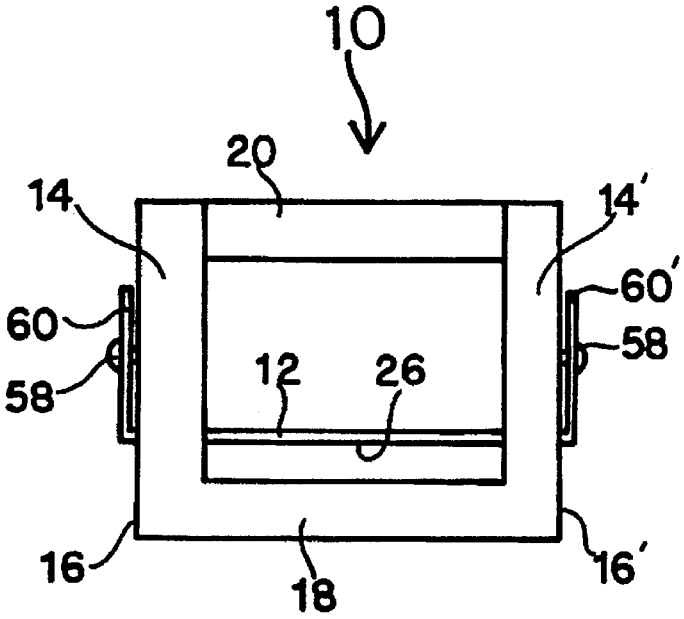
FIG. 4 is a front view of the embodiment of FIG. 1, shown without the file and ski.
Figure 5:
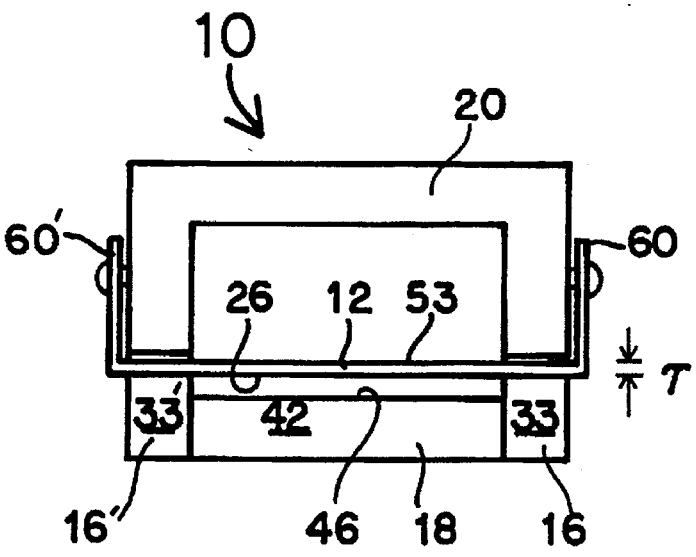
FIG. 5 is a back view of the embodiment of FIG. 1, shown without the file and ski.
Figure 6:
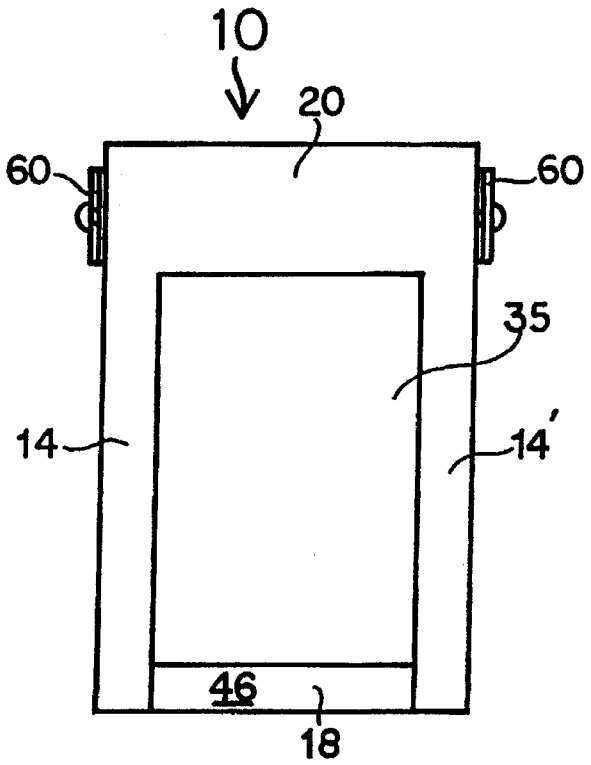
FIG. 6 is a top view of the embodiment of FIG. 1, shown without the file and ski.
Figure 7:
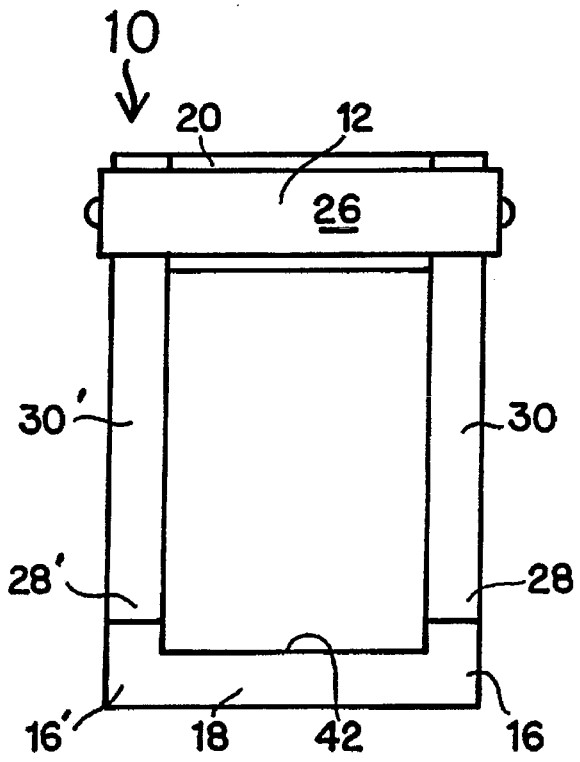
FIG. 7 is a bottom view of the embodiment of FIG. 1, shown without the file and ski.

Referring to FIGS. 1–7, there is shown one, but not the only, embodiment of the invented tool guide 10. The guide 10 comprises an elevation strip 12, two sidewalls 14, 14', two feet 16, 16', and front and back brace members 18, 20.

In use, the guide 10 generally rests on the base surface 22 of the ski 24, contacting the ski 24 in three places: the bottom surface 26 of the generally horizontal elevation strip 12 contacting the base 22, contact points 28, 28' of the sidewall bottom surfaces 30, 30' contacting the ski base 22 at or near the metal edge 31, and the generally vertical contact surfaces 33, 33'0 of the feet 16, 16' contacting the ski side 32 at or near the metal edge 31.

The sidewalls 14, 14' serve to connect the feet 16, 16' to the elevation strip 12 and to hold the feet and strip at a set distance from each other. The sidewalls 14, 14' connect to the strip 12 generally at or near the two opposing ends of the strip and extend along two sides of the file 34. The sidewalls 14, 14' are in spaced relation to each other and the space 35 between them contains the file 34 or other tool and lets the tool front end 52 contact and rest on the ski base surface 22 at or near the edge 31. The sidewalls 14, 14' contain the file 34 for guiding it along the ski during the tuning procedure, that is, as the user repeatedly moves the guide 10 and file 34 toward and away from the ski tip.

The sidewalls 14, 14', along with the front brace 18 and back brace 20, help keep the guide 10 rigid and strong, so that significant pressure may be applied during ski tuning without changing the shape of the guide, so that the sharpening and smoothing of the edge 31 may be done accurately and reproducibly. The design of two spaced feet 16, 16' and two spaced sidewalls 14, 14' is preferred because it prevents the file 34 from twisting or sliding sideways in the guide 10 and helps prevent the guide from twisting or pivoting on the ski. The sidewalls, braces, and feet are preferably made of non-flexible wood, metal, or plastic.

The open ends of the guide 10 and the preferably close but not tight fit of the file 34 between the sidewalls provide an important benefit for the tuning procedure: the file 34 may be moved along its longitudinal axis, that is, toward and away from the front brace 18, to place a fresh portion of the file abrasive surface 38 against the metal edge 31. Thus, the user may grasp the file 34 and guide 10 to move them as a unit along the ski edge, loosen his/her grasp and shift the file 34 forward or backward in the guide 10, and then resume tuning the edge with the fresh abrasive surface.

The minimizing of contact between the guide 10 and the ski 24 provides at least one important benefit: the guide 10 and file 34 unit is self-cleaning. The front brace 18 is generally parallel to, but is forwardly offset from, the contact surfaces 33, 33' of the feet. Filings and other particles removed from the edge 31 tend to fall away from the edge 31 through the gap 40 between the ski side 32 and the inner surface 42 of the front brace 18. Also, any filings that move from the edge 31 back along the base surface 22 tend to move out from the center of the guide 10 through the gaps 44, 44' that exist between the upwardly-curved (concave) bottom surfaces 30, 30' of the sidewalls 14, 14'. Preferably, the bottom surfaces 30, 30' only touch the ski over less than about ⅛ of their length, that is, at their contact points 28, 28'. In other words, more than about ⅞ of the bottom surfaces 30, 30' curves upward and does not touch the ski. Therefore, the filings do not become trapped between the guide 10 and the ski 24 and do not collect between the walls of the guide 10, and, thus, do not gouge or scratch the ski.

In use, the guide 10 rests on the ski 24 as described above, with the feet extending down along the ski side 32, and the elevation strip 12 bottom surface 26 resting on the base surface 22 between the first and second sides 32, 48 of the ski and preferably about ½–⅔ of the way from the first side 32 to the second side 48. The file 34 is inserted through the open ends of the guide 10, above the front brace 18 and between the elevation strip 12 and the back brace 20. The front brace top surface 46 is lower than the contact points 28, 28' of the sidewalls, so that the file front end 52 may rest on the metal edge 31 rather than on the front brace 18 top surface 46. The file back end 54 rests on the top surface 53 of the elevation strip 12, resulting in the file resting at a slight angle (θ) relative to the ski base 22. Therefore, the file may sharpen the edge 31 so that the base edge surface 56 lies generally at that same angle (θ) relative to the plane of the base 22.

The tuning angle, therefore, depends on the distance from the edge 31 to the elevation strip 12, which is set by the dimension of the guide 10 from the feet to the strip 12, and the thickness (T) of the strip 12. Various embodiments may be made for the different tuning applications, for example, ½°, 1°, or 2°, preferably by including increasing thickness of strip 12 for increasing angles.

The elevation strip 12 is preferably has two upending side extensions 60, 60', which are connected to the sidewalls 14, 14' in a pivotal manner, for example, by screws 58 that let the strip 12 pivot slightly around the screw shafts. This pivotal feature allows the strip 12 to move slightly to place the strip bottom surface 26 flat on the base surface 22, so that the strip edge or corners do not gouge or scrape the ski. The strip 12 is preferably polished stainless steel, but may be other durable and smooth materials.

The preferred guide 10 is a single, compact and lightweight unit, comprising the strip 12 and a frame made of the sidewalls with depending feet and front and back braces. The preferred guide 10 may easily be sized for a variety of tools.

Other embodiments of the guide, besides the preferred design, are still within the scope of this invention. A guide may be made with more or less structure, as long as the guide is rigid and durable. For example, a front or back brace may be eliminated, or one of the two sidewalls may be eliminated. For example, the front brace and back brace may be positioned differently or may be combined into a single cross member, as long as it does not interfere with the file placement and does not trap filings. A variety of means may be used for connecting the elevation strip to the guide, or, alternatively, the strip may be integral with the guide, as long as the strip is formed so that no protrusions or edges will mar the ski surface. The elevation member may be differently-shaped, for example, a bar or a rod.

Although this invention has been described above with reference to particular means, materials, dimensions, embodiments, and methods of installation, it is to be understood that the invention is not limited to these disclosed particulars, but extends instead to all equivalents within the scope of the following claims.

I claim:

1. A guide for holding a tool having a front end and a back end and for placement on a ski having a base surface with a central region, a side surface, and an edge to be sharpened at a junction of the base and side surfaces, the guide comprising:

a generally horizontal elevation member having a bottom surface for placement on the central region of the ski base surface and having a top surface for supporting the tool back end in an elevated position above the ski base surface, a generally vertical foot for extending down along and contacting the ski side surface near the ski edge to be sharpened, and a spacing member connecting the foot to the elevation member so that the foot and elevation member are at a distance from each other, wherein the spacing member has a contact point for resting on the ski base surface, and wherein a space is located between the said foot and the elevation member for allowing the tool front end to rest on the said ski edge.

2. A guide as set forth in claim 1, wherein the elevation member is connected to the spacing member in a pivotal manner.

3. A guide as set forth in claim 1, wherein the spacing member has a concave-curved bottom surface so that greater than about ⅞ of the spacing member bottom surface does not touch the ski base surface, for allowing filings to move between the spacing member bottom surface and the ski base surface.

4. A guide for holding a tool having a front end and a back end and for placement on a ski having a base surface with a central region, a side surface, and an edge to be sharpened at a junction of the base and side surfaces, the guide comprising:

a generally horizontal elevation member having two opposing ends, a bottom surface for placement on the central region of the ski base surface and having a top surface for supporting the tool back end in an elevated position above the ski base surface, two sidewalls connected in spaced relation to the two opposing ends of the elevation member for extending to the ski edge, wherein each of said sidewalls has a contact point for resting on the ski base surface, two generally vertical feet, one of said feet extending down from each of the said two sidewalls, wherein each of said feet has a contact surface for contacting the ski side surface near the ski edge to be sharpened, and wherein a space is located between the said sidewalls for receiving the tool front end and allowing the tool front end to rest on the said ski edge.

5. A guide as set forth in claim 4, wherein the elevation member is connected to the two sidewalls in a pivotal manner.

6. A guide as set forth in claim 4, wherein each of the two sidewalls has a concave-curved bottom surface so that greater than about ⅞ of the sidewall bottom surface does not touch the ski base surface, for allowing filings to move between the sidewall bottom surface and the ski base surface.

7. A guide as set forth in claim 4, further comprising a front brace connecting the said two feet, wherein the front brace extends between the two feet in a plane generally parallel to but distanced from the feet contact surfaces, for creating a gap between the front brace and the ski side surface.

8. A guide for holding a tool having a front end and a back end and for placement on a ski having a base surface with a central region, a side surface, and an edge to be sharpened at a junction of the base and side surfaces, the guide consisting of:

a generally horizontal elevation member having two opposing ends, a bottom surface for placement on the central region of the ski base surface and having a top surface for supporting the tool back end in an elevated position above the ski base surface, and a frame comprising:

two sidewalls connected in spaced relation to the two opposing ends of the elevation member for extending to the ski edge, wherein each of said sidewalls has a contact point for resting on the ski base surface, two generally vertical feet, one of said feet extending down from each of the said two sidewalls, wherein each of said feet has a contact surface for contacting the ski side surface near the ski edge to be sharpened, and wherein a space is located between the said sidewalls for receiving the tool front end and allowing the tool front end to rest on the said ski edge.

9. A guide as set forth in claim 8, wherein the elevation member is connected to the two sidewalls in a pivotal manner.

10. A guide as set forth in claim 8, wherein each of the two sidewalls has a concave-curved bottom surface so that greater than about ⅞ of the sidewall bottom surface does not touch the ski base surface, for allowing filings to move between the sidewall bottom surface and the ski base surface.

11. A guide as set forth in claim 8, wherein the frame further comprises a front brace connecting the said two feet, wherein the front brace extends between the two feet in a plane generally parallel to but distanced from the feet contact surfaces, for creating a gap between the front brace and the ski side surface.

* * * * *